US006071578A

United States Patent [19]

Richardson et al.

[11] Patent Number: 6,071,578

[45] Date of Patent: Jun. 6, 2000

[54] TUBULAR FABRIC AND METHOD OF MAKING THE SAME

[75] Inventors: Roy Richardson, Coalville; Robert Arthur Glenn, East Leake, both of United Kingdom

[73] Assignee: Price Shepshed Limited, Leicestershire, United Kingdom

[21] Appl. No.: 08/843,988

[22] Filed: Apr. 17, 1997

[30] Foreign Application Priority Data

Apr. 18, 1996 [GB] United Kingdom ..... 9608059

[51] Int. Cl.[7] ..... B23B 5/00; D03D 15/08

[52] U.S. Cl. ..... 428/36.3; 442/168; 442/182; 442/183; 442/306; 156/181; 156/307.3

[58] Field of Search ..... 428/36.3, 36.1; 442/183, 184, 182, 306, 105, 168, 169; 156/181, 307.3

[56] References Cited

U.S. PATENT DOCUMENTS

| | | | |
|---|---|---|---|
| 3,255,030 | 6/1966 | Storti | 442/105 |
| 3,594,262 | 7/1971 | Magidson | 442/183 X |
| 3,620,892 | 11/1971 | Wincklhofer et al. . | |
| 5,395,665 | 3/1995 | Planeta | 428/36.3 X |
| 5,749,400 | 5/1998 | Pascual | 442/182 X |

FOREIGN PATENT DOCUMENTS

| | | |
|---|---|---|
| 19 22 803 | 2/1970 | Germany . |
| 1 512 906 | 6/1978 | United Kingdom . |
| 2247696 | 3/1992 | United Kingdom . |

*Primary Examiner*—Daniel Zirker
*Attorney, Agent, or Firm*—Hill & Simpson

[57] ABSTRACT

The present invention relates to a tubular fabric for receiving an underwire in a garment such as a bra. The tubular fabric is formed by arranging a fusible yarn, such as Grilon (Registered Trade Mark), on the interior surface of the tube and melting said yarn to coat the interior surface.

On cooling the melted yarn sets to form a durable lining which exhibits excellent resistance to penetration by underwires.

The invention also relates to garments, such as bras, basques and swimming costumes, incorporating the tubular fabric of the invention.

20 Claims, 3 Drawing Sheets

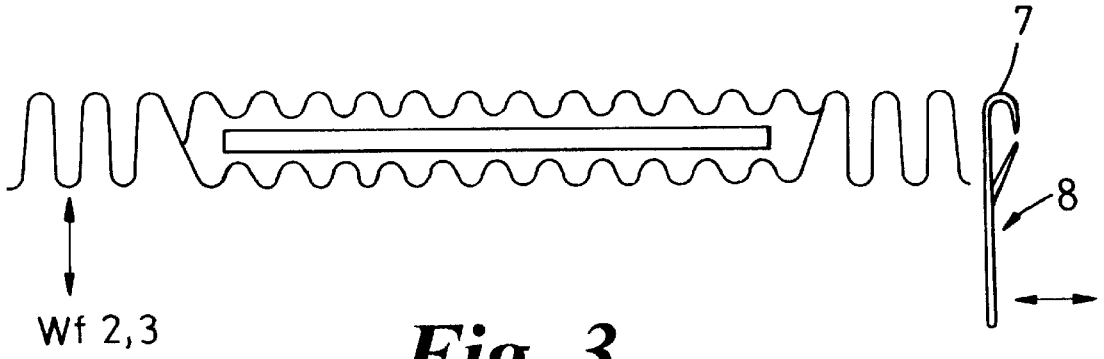
*Fig. 3*
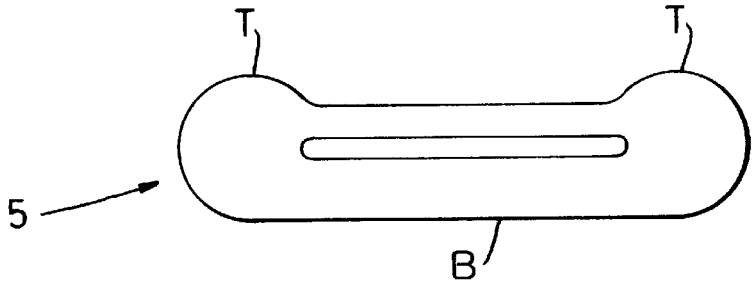
*Fig. 4*
X = FULL LIFT
○ = HALF LIFT MIDDLE TOP
□ = HALF LIFT MIDDLE BOTTOM
| | | | | | | | | | |
|---|---|---|---|---|---|---|---|---|---|
| | X | | ○ | | □ | | | ○ | |
| | X | ○ | | □ | | | | ○ | ○ |
| X | | | ○ | | □ | | □ | ○ | ○ |
| X | | ○ | | □ | | | | ○ | ○ |
| | X | | ○ | | □ | | | | ○ |
| | X | ○ | | □ | | | | ○ | ○ |
| X | | | ○ | | □ | □ | | ○ | ○ |
| X | | ○ | | □ | | | | ○ | ○ |
| 1 | 2 | 3 | 4 | 5 | 6 | 7 | 8 | 9 | 10 |
*Fig. 6*

TUBULAR FABRIC AND METHOD OF MAKING THE SAME

BACKGROUND OF THE INVENTION

1. Field of the Invention

The present invention relates to a tubular fabric, a method of making the same, and to articles manufactured therefrom, particularly underwired garments such as brassieres.

2. Description of Related Art

It is known to produce fabric tubing for receiving a curved underwire. Conventionally such fabric tubing is made by forming three separate fabric strips. The strips are folded and sewn together to form a tube into which an underwire can be received.

A considerable problem with known fabric tubing for underwires is that the ends of the underwires can penetrate the tubing, either during the course of garment manufacture or in use by a wearer.

At present, a significant proportion of brassière (bra) manufacturers products are returned because of protrusion of the underwire through the fabric tubing.

Underwire protrusion through the tubing is perhaps most commonly the result of washing the garment such as a bra in a washing machine. Whilst such washing is not presently recommended by garment manufacturers, it is commonplace. Clearly, product failure as a result of underwire protrusion is costly and can have a deterious effect on customer satisfaction.

BRIEF SUMMARY OF THE INVENTION

The present invention seeks to avoid the above and other problems of the prior art.

According to the invention there is provided a tubular fabric which is particularly useful for receiving an underwire the fabric comprising a support yarn and an elastomeric yarn; and characterised in that a fusible yarn is arranged within the fabric tube so that it is capable of forming a penetration barrier.

The fusible yarn is a very important feature of the invention.

By "fusible yarn" we include the meaning that the yarn can be melted at a predetermined temperature and cooled to adhere to the support yarn. Advantageously, the fusible yarn melts at less than 100° C., especially 90° C. or less, and can be cooled to produce a material having a higher melting point than the predetermined temperature, and preferably more than 100° C.

The most preferred fusible yarn for use in the invention is a polyamide yarn, especially that sold by EMS-CHEMIE AG of CH-7013 Domat/EMS, Switzerland under the Registered Trade Mark GRILON.

Advantageously, the fusible yarn is in the form of a multifilament, preferably comprising 14 filaments.

Whilst fusible yarn in the form of monofilaments, such as those produced by Luxilon Industries in Belgium (under the trade name "Luxilon"), or Toray Industries in Japan, could be used in the present invention, a multifilament yarn is preferred because on melting it spreads more easily over the fabric. In contrast, the melting of a monofilament produces a less even spread which may be less comfortable to a wearer of a finished garment incorporating the tubular fabric of the invention.

Preferably, the fusible yarn is treated by heating whereby it melts and spreads over the interior surface of the tubular fabric. On cooling, the fusible yarn adheres to the other yarns of the fabric to produce a tubular fabric having a durable inner lining of the melted fusible yarn.

Preferably, when the fusible yarn is a polyamide the treatment to melt the fusible yarn comprises a conventional polyamide fabric dyeing process.

The temperature involved in the dyeing process exceeds the melting point of the fusible polyamide yarn. Conveniently, the fusible polyamide yarn is GRILON having a melting point of 85° C. Typical polyamide dyeing processes reach temperatures of around 100° C.

A particular preferred feature of GRILON is that on cooling it retains a melting point "memory" for the temperature reached during the dyeing process ie after the dyeing process its melting point changes from 85° C. to 100° C. or more. It will be appreciated that this feature confers the important advantage that the tubular fabric product will not deteriorate on washing by a user in a washing machine because the "new" melting point of the melted fusible yarn will not be reached during normal washing.

A skilled person will understand that a fusible yarn of the invention is intended to include any yarn which can melt at a predetermined temperature and adhere to other yarns of the fabric to form a penetration barrier. On cooling, the melted fusible yarn preferably produces a coating which has a temperature in excess of the predetermined temperature and preferably in excess of 100° C.

The tubular fabric comprises an elastomeric yarn to lend the fabric a desirable degree of flexibility or "give". This is important as the fabric must be curved to receive an underwire. If the fabric did not include the elastomeric yarn it would not lie flat when the underwire was in position, making the finished product unappealing aesthetically. A skilled person will appreciate that a range of elastomeric yarns could be employed. However, an elastane eg Lycra (Registered Trade Mark) is preferred both for its well proven performance and widespread commercial acceptance. A particularly preferred lycra yarn is distributed by Wykes of Leicester, England under their product code S540 and comprises a core of 235 decitex (dtex) Lycra (Du Pont) covered on top by 1 fold 78 dtex textured 18 filament Nylon 6 (Du Pont) and on the bottom by 1 fold 78 dtex textured 18 filament Nylon 6 (Du Pont).

Preferably, the support yarn is a polyamide, especially a textured polyamide. The support yarn is preferably composed of multifilaments. Preferred support yarns include Nylon 6 or Nylon 66 sold by Du Pont which comprises a 20 filament textured polyamide yarn.

It is preferred that the fusible yarn and the support yarn are composed of the same material, advantageously a polyamide, so that they can be adhered to one another easily and so that their respective dyeing properties will be the same. A uniformity of dyeing throughout the fabric of the invention is an important commercial and aesthetic consideration.

The term "underwire" is intended to include any substantially rigid structural member and it need not be made from a metal. For example, a structural member formed from a substantially rigid plastic or from bone may be preferred in certain garments incorporating the tubular fabric of the invention. Such structural members are intended to fall within the scope of the term "underwire" as used herein.

In a further aspect the invention provides a method for making a tubular fabric for receiving an underwire comprising providing a support yarn and an elastomeric yarn;

characterised in that a fusible yarn is also provided and the yarns are formed into a tubular fabric whereby fusible yarn is arranged within the fabric tube so that it is capable of forming a penetration barrier.

Preferably, the yarns are formed into a tubular fabric by a weaving process. Whilst the tubular fabric can also be formed by a knitting process, a weaving process is preferred because, in general, weaving produces a denser fabric than an equivalent knitting process. Also, a knitted fabric is typically less comfortable than a woven fabric due to its more open structure.

The fabric tubing is preferably formed by weaving two fabric tapes. The tapes are overlaid and their edges joined by edge threads, rising from the bottom tape to the top tape and vice versa.

Each tape preferably has two weft threads (one being fusible yarn and the other support yarn) inserted by one needle and knitted by a catch thread onto a latch needle.

It is possible to make a similar tubular fabric using a single weft needle. However, the production rate would be reduced significantly in comparison to the rate possible with a double weft needle. This is because the single needle would require approximately twice the number of picks to produce a fabric having the same strength as that produced by a double needle.

The weaving operation can be performed using a conventional narrow fabric loom. A preferred loom is produced by Jakob Müller AG, of Frick CH-5070 Frick, Switzerland and is known as Model Müller NF 6/27, and is fitted with a Muller NF system 3 catch thread attachment.

Preferably, threads are woven more loosely on one side (bottom) and the edges of the other side (top) to produce "soft" surfaces for increased comfort to a subsequent wearer.

Preferably the yarns are textured for improved comfort and low shrinkage properties. Advantageously, the yarns are composed of multifilaments.

A particularly preferred polyamide yarn is 2 fold 78 dtex textured Nylon 6 or Nylon 66 comprising 20 air mingled filaments. These yarns are available from Du Pont.

Preferably, the fusible yarn is 1 fold 75 dtex 14 filament GRILON K-85, available from EMS, Switzerland.

Preferably the fabric further comprises a catch thread which serves to make a smaller softer knitted edge. Conveniently, the catch thread comprises 1 fold 44 dtex air mingled 13 filament textured Nylon 6 or Nylon 66 (Du Pont).

A skilled person will appreciate that the term decitex (dtex) refers to the thickness of the yarn. Yarns having a lower dtex than the preferred dtex mentioned above would produce a thinner fabric which may be less comfortable to wear. Yarns with a higher dtex would produce a thicker fabric which may be less flexible.

In the finished fabric weight the percentages of the different yarns are preferably in the ranges:

(i) fusible yarn 5–15%, especially approximately 8%

(ii) Elastomeric yarn 0.5–10%, especially 1–2%

(iii) catch thread less than 1%

(iv) support yarn—balance to give 100%

If monofilament yarn is used for the fusible yarn, more yarn may be required to achieve satisfactory spreading, and the preferred range is from 5–20%, especially approximately 10%.

Preferably, the method of the invention comprises a further step of treating the tubular fabric by heating to melt the fusible yarn so that it spreads over the tubular fabric and is capable of forming a penetration barrier. On cooling, the melted yarn adheres to the other yarns of the fabric to form a durable inner tube lining.

Advantageously, when the fusible and support yarns are polyamide the treatment comprises a conventional polyamide fabric dyeing process which involves temperatures in excess of the melting point of the fusible yarn.

The preferred fusible polyamide yarn is 1 fold 75 dtex 14 filament Grilon yarn, which has a predetermined melting point of approximately 85° C.

Dyeing can be achieved using a continuous pad/steam process, or by a batch process. In both methods the process is preferably controlled so that the temperature does not fall below a predetermined temperature which is in excess of the melting point of the fusible yarn. The dyeing temperature is typically 100° C. or more.

After dyeing, the dyed fabric tubing is dried and cooled.

Conveniently, the fabric can be further treated with a normal dyed fabric finishing step such as acid treatment (using citric acid) to reduce the pH of the finished fabric to less than 4 and thereby protect the fabric from phenolic yellowing which can arise if the fabric is exposed to nitrogen oxide fumes.

The fabric tubing produced in accordance with the invention has a durable inner lining of fusible yarn which is extremely resistant to penetration by underwires.

Independent tests conducted by Inchcape Testing Services of England have demonstrated that the fabric tubing of the invention is over twice as resistant to underwire penetration as conventional fabric tubing and retains this resistance after repeated washing in a tumble drier at 50° C. In contrast to known fabric tubing, the advantageous resistance to penetration property of the fabric tubing of the invention makes it well-suited for use in underwired garments intended for machine rather than hand washing. in contrast to known fabric tubing.

Preferred embodiments of the invention will now be described by way of non-limiting examples.

DESCRIPTION OF THE DRAWINGS

FIG. 3 shows the weft paths in the fabric;

FIG. 4 is an end view of fabric tubing according to the invention;

FIG. 6 shows the Heald frame lifting plan for weaving a fabric tubing in accordance with the invention.

The preferred fusible polyamide, Grilon K-85 (Registered Trade Mark), has a melting point of approximately 85° C. and a preferred yarn count dtex of 75. According to the manufacturer's technical data sheet Grilon K-85 has the following properties:

| | | |
|---|---|---|
| Melting range | 78–88° C. | (172–190° F.) |
| Application temperature range | 95–120° C. | (203–248° F.) |
| Melt viscosity DIN 53735, | 160° C./21.6 N | 900 Pa · s |
| Yarn count | 75 dtex 14 filaments | |
| Tenacity | 28 cN/tex | |
| Elongation at break | 40–70% | |
| Twist | 300 Z T/m | |
| Wash resistive | 40° C. | |
| Dry cleaning resistance | PER-Chloro resistant | |

1. Formation of Tubular Fabric

Figure 1:
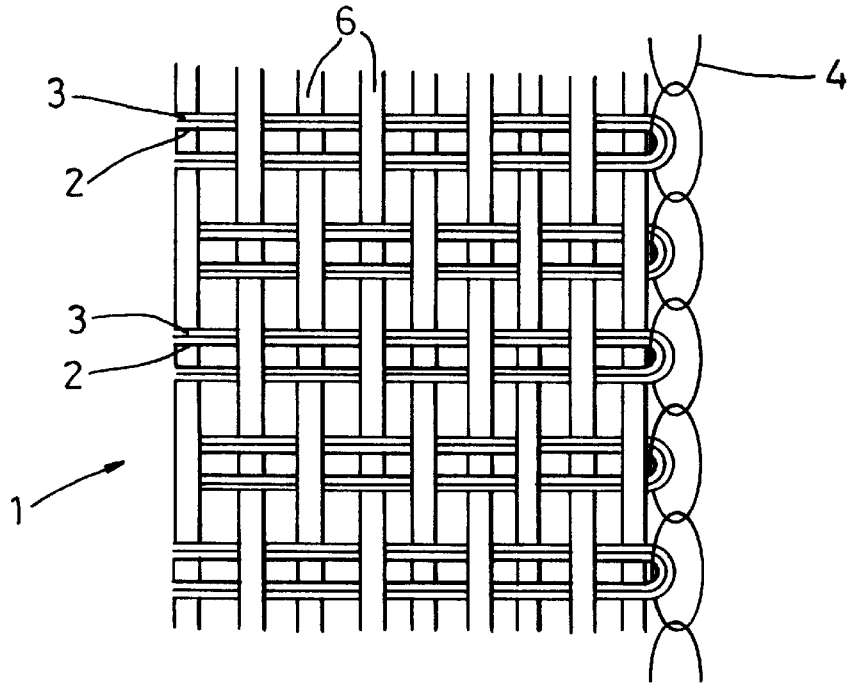
FIG. 1 is a plan view showing a fabric tape produced according to a preferred weaving method of the invention.
Figure 5:
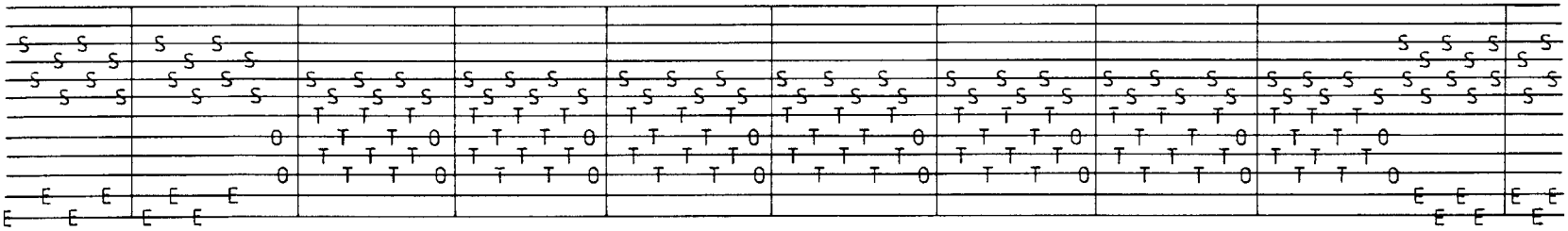
FIG. 5 shows the drawing in and front reed plan for weaving fabric tubing in accordance with a preferred method of the invention.

As shown in FIG. 1, a preferred fabric tubing 1 of the invention comprises textured polyamide 2 and Grilon 3 weft threads Wf and polyamide warp threads 6 woven into two tapes which are overlaid and their edges joined by edge threads 4, rising from the bottom tape to the top tape and vice versa, to form a tube 5. The tube also includes an elastomeric yarn, as shown in FIG. 5 (reference letter O).

Each tape has its two weft threads Wf inserted by one needle N and knitted by a catch thread 7 onto a latch needle 8. Threads are preferably woven more loosely onto one side (bottom) B and the edges of the other side (top) T to give the fabric tube a soft feel to a wearer, as shown in FIG. 4.

The tubular fabric is preferably produced using a Müller model NF 6/27 Narrow Fabric Loom fitted with a catch thread attachment (Müller NF System 3).

The loom includes twelve Heald frames. To produce each tape of fabric 2 weft needles, a catch thread attachment, 4 weft thread feeds and 4 weft thread stop motions (designed to stop the machine should the weft thread break) are employed.

Figure 2:
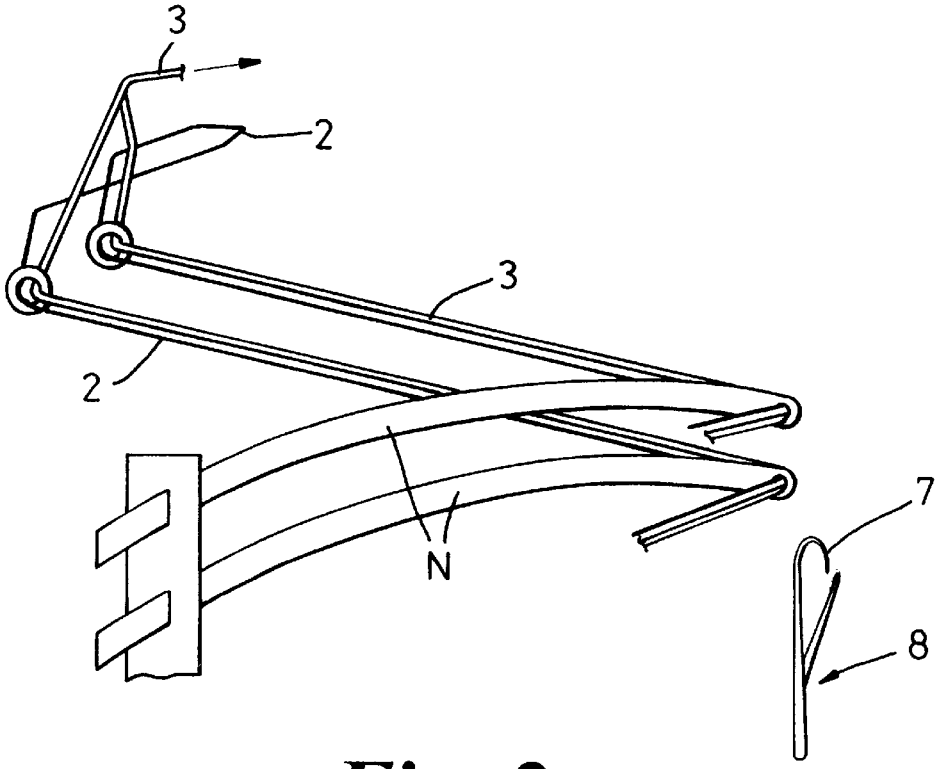
FIG. 2 shows the weft yarns, weft needles and the catch thread latch needle used in the preferred weaving method.

As shown in FIG. 2 a double weft needle is used, with each needle B carrying two weft threads 2, 3.

The loom settings are within the general knowledge of skilled person and are as set out in the relevant manufacturer's operation manual.

TABLE 1

| MATERIAL COMPOSITION | Beam Ends | YARN fold/dtex/ No. filament | COLOUR |
|---|---|---|---|
| S = Soft Face | 1 × 74 | 2/78/20 Textured Nylon Air Mingled | White |
| T = Tube | 1 × 70 | 2/78/20 Texture Nylon Air Mingled | White |
| E = Edge | 1 × 16 | 2/78/20 Textured Nylon Air Mingled | White |
| O = Elastomeric | 1 × 16 | S 540 (Wykes) | White |
| Catch thread | 1 | 1/44/13 Textured Nylon Air Mingled | White |
| Weft | 2 | 2/78/20 Textured Nylon Air Mingled | White |
| Weft | 2 | 1/75/14 Non-Textured Grilon K85 | White |
| Reed Per cm | 10/8 | Per 1" 26/8 | |
| Picks Per cm | 13 to 19.5 | Per 1" 33–50 | |
| Elongation | 25% | | |
| m/c Width | 10 mm | | |
| m/c Elongation | 20% | | |

FIGS. 5 and 6 show a drawing in and reed plan and the Heald frame lifting plan to be followed to produce a preferred tubular fabric from the materials given in Table 1, by a weaving process according to the invention.

As mentioned previously, the tubular fabric could be produced by a knitting process employing a known fine gauge multi-bar warp or crochet knitting machine.

The preferred method of the invention produces a tubular fabric comprising a polyamide yarn, an elastomeric yarn and a fusible polyamide yarn, preferably Grilon K-85, capable of forming a penetration barrier within the fabric tube. Whilst such a product may be a valuable commercial product in itself, it is preferably subjected to a further heat treatment step to provide a durable lining of fused polyamide on the interior surface of the fabric tubing.

2. Heat Treatment to Form Durable Tube Lining

In the preferred method the heat treatment step is carried out by a conventional polyamide dyeing process. The batch dyeing process is preferred when the fabric is to be dyed with dark colours such as red, black or blue, whereas the continuous dyeing process is preferred for whites, creams and pastel colours.

2. (i) A suitable continuous pad-steam dyeing process of the invention can be carried out with a conventional dyeing machine such as a MAGEBA (Registered Trade Mark) Pad Steamer range produced by MAGEBA Textile machines GMBH & Co.

Preferably the conventional device is modified by the addition of a temperature sensing means which monitors the temperature within the dyeing machine. If the temperature falls below a predetermined level eg 90° C. (in excess of the melting point of the fusible Grilon yarn, an indicator such as a flashing light or buzzer is activated to warn an operator so that appropriate action can be taken to increase the temperature, as required.

Undyed tubular fabric of the invention is fed, at a rate of approximately 15 meters per minute, into the dye padding unit of the dyeing machine which utilises a conventional polyamide dye (eg available from Hoechst, Ciba-Geigy and Sandoz etc). The fabric then passes into the atmospheric steamer unit where the fusible Grilon yarn melts. The fabric is then passed into excess dye wash off baths, size tanks and into drying cylinders (eg a drying unit sold by Mageba).

Throughout the process the fabric is maintained under a fixed tension by means of appropriately positioned automatic dancer arms.

The fabric residence time in the steamer unit is 2–3 minutes, preferably 2.75 minutes at a temperature of from 100–105° C. The tubular fabric is dried uniformly whilst controlling the tension of the fabric so that the dimensional stability of the fabric is optimised.

2. (ii) In the batch drying process a known Pegg Pulsator can be used. This machine comprises a stainless steel tank in which a dyeing solution can be heated and stirred.

Fabric to be dyed is assembled into 50 meter hanks tied loosely with string bands. The hanks are put into a dyeing solution and heated until the solution boils (which melts the Grilon K-85 yarn). Boiling is preferably continued for at least approximately 45 minutes. The dyed fabric hanks are then removed from the tank, rinsed and dried.

A temperature control is used to warn the operator if the temperature falls below 90° C. during the boiling step.

The tubular fabric of the invention is particularly suitable for receiving underwires and is useful in the manufacture of a range of underwired garments including bras, basques and swimming costumes.

The following tests demonstrate the increased resistance to penetration afforded by the tubular fabric of the invention compared to known fabric tubing for receiving underwires.

3. The penetration force through the fabrics was measured using a strain gauge on a L+M Sewability Tester with a 90's medium ball needle to represent an underwire. The various component fabrics were pushed over the needle and the force required to penetrate the fabric was measured.

Various fabric thicknesses were measured as follows:

A) White Woven Fabric Tube produced according to the invention.

1) The fabric was split open

2) Each side was tested

B) Conventional White Warp Knitted Fabric Tube for underwires

1) Single thickness outer fabric

2) Single thickness inner fabric

3) Double thickness inner tube

| Results | Original (unwashed) penetration force |
|---|---|
| A1 | 200 g Plain |
| A2 | 300 g Brushed |
| B1 | 40 g |
| B2 | 50 g |
| B3 | 120 g |

After repeated washing@ 50° C. Tumble Dry

| Results | 1st | 2nd | 3rd | 4th | 5th | 6th |
|---|---|---|---|---|---|---|
| A1 (Plain) | 230 g | 210 g | 200 g | 200 g | 200 g | 200 g |
| A2 (Brushed) | 340 g | 300 g | 280 g | 270 g | 270 g | 270 g |
| B1 | 30 g | 40 g | 30 g | 50 g | 50 g | 60 g |
| B2 | 40 g | 40 g | 60 g | 70 g | 60 g | 70 g |
| B3 | 100 g | 90 g | 80 g | 80 g | 80 g | 90 g |

Comparing the forces required to penetrate A2 B2 and B3, it is clear that the fabric of the invention is two or three times more resistant to penetration then a known fabric used for receiving underwires in bras.

We claim:

1. A method for making a tubular fabric comprising the steps of:

providing a support yarn and an elastomeric yarn; and providing a fusible yarn wherein the yarns are formed into a tubular fabric whereby the fusible yarn is arranged within the fabric tube so that it is capable of forming a penetration barrier.

2. A method as claimed in claim 1 wherein the yarns are formed into a tubular fabric by weaving.

3. A method as claimed in claim 1 wherein the fusible yarn is composed of multifilaments.

4. A method as claimed in claim 1 wherein the fusible yarn and/or support yarn are made from a polyamide.

5. A method as claimed claim 1 wherein the fusible yarn has a melting point of from 75 to 90° C.

6. A method as claimed in claim 1 wherein the fusible yarn has a melting point of approximately 85° C.

7. A method as claimed in claim 1 wherein the fusible yarn is a polyamide yarn which has substantially the same properties as the yarn known as Grilon K-85.

8. A method as claimed in claim 1 wherein the elastomeric yarn is an elastane.

9. A method according to claim 8 wherein the elastane is known as Lycra.

10. A method according to claim 1 wherein the elastomeric yarn is covered with a polyamide yarn.

11. A method as claimed in claim 4 wherein the polyamide yarn is textured.

12. A method as claimed in claim 4 wherein the polyamide yarn is composed of a plurality of filaments.

13. The method as claimed in claim 1 further comprising the step of:

treating the tubular fabric by heating whereby the fusible yarn melts and spreads over the interior surface of the tubular fabric to produce a penetration barrier within the fabric tube.

14. A method as claimed in claim 13 wherein the treatment by heating comprises a polyamide fabric dyeing process.

15. A method as claimed in claim 13 wherein the temperature is 100° C. or more.

16. A method as claimed in claim 13 further comprising the step of locating an underwire within a length of the tubular fabric.

17. A method as claimed in claim 16 further comprising the step of incorporating the tubular fabric into a garment before or after the underwire is located.

18. A method as claimed in claim 17 wherein the garment is selected from a bra, a basque or a swimming costume.

19. A tubular fabric comprising:

a support yarn and an elastomeric yarn; and a fusible yarn arranged so that it is capable of forming a penetration barrier within the fabric tube.

20. The tubular fabric as claimed in claim 19 wherein the fusible yarn has been melted.

* * * * *